United States Patent [19]

Bartling

[11] 4,051,654

[45] Oct. 4, 1977

[54] OPEN END SPINNING MACHINE

[75] Inventor: Gerhard Bartling, Burgstetten, Germany

[73] Assignee: SKF Kugellagerfabriken GmbH, Schweinfurt, Germany

[21] Appl. No.: 718,373

[22] Filed: Aug. 27, 1976

[30] Foreign Application Priority Data

Sept. 3, 1975 Germany ..... 2539088

[51] Int. Cl.[2] ..... D01H 1/12

[52] U.S. Cl. ..... 57/58.89; 57/93

[58] Field of Search ..... 57/1 R, 58.89–58.95, 57/104, 105, 93

[56] References Cited

U.S. PATENT DOCUMENTS

| | | | |
|---|---|---|---|
| 3,375,649 | 4/1968 | Bures et al. | 57/104 X |
| 3,805,506 | 4/1974 | Stahlecker | 57/58.89 X |
| 3,807,157 | 4/1974 | Stahlecker | 57/58.89 |
| 3,861,132 | 1/1975 | Stahlecker et al. | 57/58.89 |
| 3,934,396 | 1/1976 | Stahlecker et al. | 57/58.89 |
| 3,958,846 | 5/1976 | Donner | 57/58.89 X |
| 3,972,171 | 8/1976 | Handschuch et al. | 57/58.89 |
| 3,975,894 | 8/1976 | Suzuki | 57/58.89 |
| 3,981,132 | 9/1976 | Miyazaki et al. | 57/58.89 |

*Primary Examiner*—John Petrakes

[57] ABSTRACT

An open end spinning machine in which each spinning unit is housed in a bipartite housing, each part of the housing having cooperating contact and counter-contact surfaces for forming a sealed housing.

9 Claims, 5 Drawing Figures

OPEN END SPINNING MACHINE

BACKGROUND OF THE INVENTION

The present invention relates to the construction of open end spinning units and, in particular, to the construction of the vacuum housing therefor.

An open end spinning machine has become known through German Patent publication DT-OS No. 2,130,739 in which, as is generally the practice and which in a practical example is shown in Swiss patent CH-PS No. 474,579, there are provided, on a frame fixed to the machine, spinning units which are disposed in side-by-side juxtaposition. Each unit has a housing for the accommodation of insertable and removable bearing housing for the spin rotor, and a separating roller. The driving means for the spin rotor and/or the separating roller are conducted over guide members connected to the machine frame. Each spinning unit as a whole is movable relative to the machine frame.

For practical purposes, arrangements of this kind have the advantage that the self-contained spinning unit is movable and/or pivotal away from the driving means, for instance, for the purpose of stopping during general maintenance work, or for cleaning purposes of the respective spinning unit.

Viewed from the aspect of the fundamental design of such spinning units, they are equipped exclusively for only one certain rotor shaft bearing size and bearing type, and do not offer the possibility of meeting in every instance the many requirements of modern practice, in particular with respect to the operating speeds of the spin rotor.

For example, open end spinning machines have become known in which the spin rotors are mounted in supporting or backing roller pairs, along whose outer peripheral surfaces the spin rotor shaft rolls which, in turn, is driven directly by a driving means, in most cases involving an endless drive belt revolving alongside the machine. See, for example, German patent specification, DT-OS No. 2,123,231.

Mountings of this type of bearing, in practical application, also have a defined area in which they are used and they cannot meet to the desired extent the great variety of requirements of open end spinning.

The same naturally applies also to driving modes where the spin rotor is driven by an electric motor attached to the spin rotor bearing housing which forms a unit with the electric motor as, for example, disclosed in German patent DT-OS No. 2,106,898.

It is an object of the present invention to provide an open end spinning machine in which all advantages of different bearing types can be fully utilized for the practical operating range without requiring a modification of the structural elements forming the spinning unit and the housing enclosing it. This ensures that, depending on the field of application of respective spinning units, the bearing type best suited for this particular field can be joined to the spinning unit housing, thereby also ensuring the best possible economy.

The foregoing objects, other objects as well as numerous advantages will be seen from the following disclosure of the present invention.

SUMMARY OF THE PRESENT INVENTION

According to the present invention, an open end spinning machine having a plurality of units is provided in which each of the units is provided with a first and second section. The first section is adapted to form the chamber housing, the spin rotor, as well as other elements if desired. The second section is adapted to accomodate the bearing for the rotor shaft. The first and second housing portions are provided with cooperatively engaging contact surfaces respectively which interlock or engage to secure the housing against rotation, and axial and radial movement. The two housing portions may be secured together by screws or bolts or the contact surfaces may be formed by teeth-like segments or bayonet segments.

The drive means for the rotor shaft may be adjustably positioned by guide means which are selectively secured to the frame of the machine so as to be positioned at any point along the axis of the rotor shaft, thereby being adaptable in use respective of the specific rotor shaft bearing employed. The drive means may also be an individual electric motor for each rotor shaft.

It will be seen from the foregoing that notwithstanding the variations and modifications possible and the exchangeability of the bearing systems, the two-part housing provides a vacuum box, properly sealed, and ensures the location of the spin rotor about the correct spin axis, relative to the fiber feed and withdrawal systems.

As a result, the rotor shaft bearings can be designed in the form of a roller bearing known per se as well as a fluid bearing or an indirectly supporting paired backing roll bearing. A common driving means such as a drive belt can be used to drive the most varied types of mountings. It is expedient to design the components accommodating the driving means within the machine frame appropriately wide or adjustable, and to conduit them over appropriately disposed guiding means, so that whatever rotor shaft bearing is used, they will be equally applicable.

In addition, within the scope of the invention, the spin rotor can also be driven by means of an electric motor fixed to the bearing housing without thereby impairing the drive system of the other elements of the spinning unit or of other machine parts.

Full details of the present invention are set forth in the following description and in the accompanying drawing.

DESCRIPTION OF THE INVENTION

Figure 1:
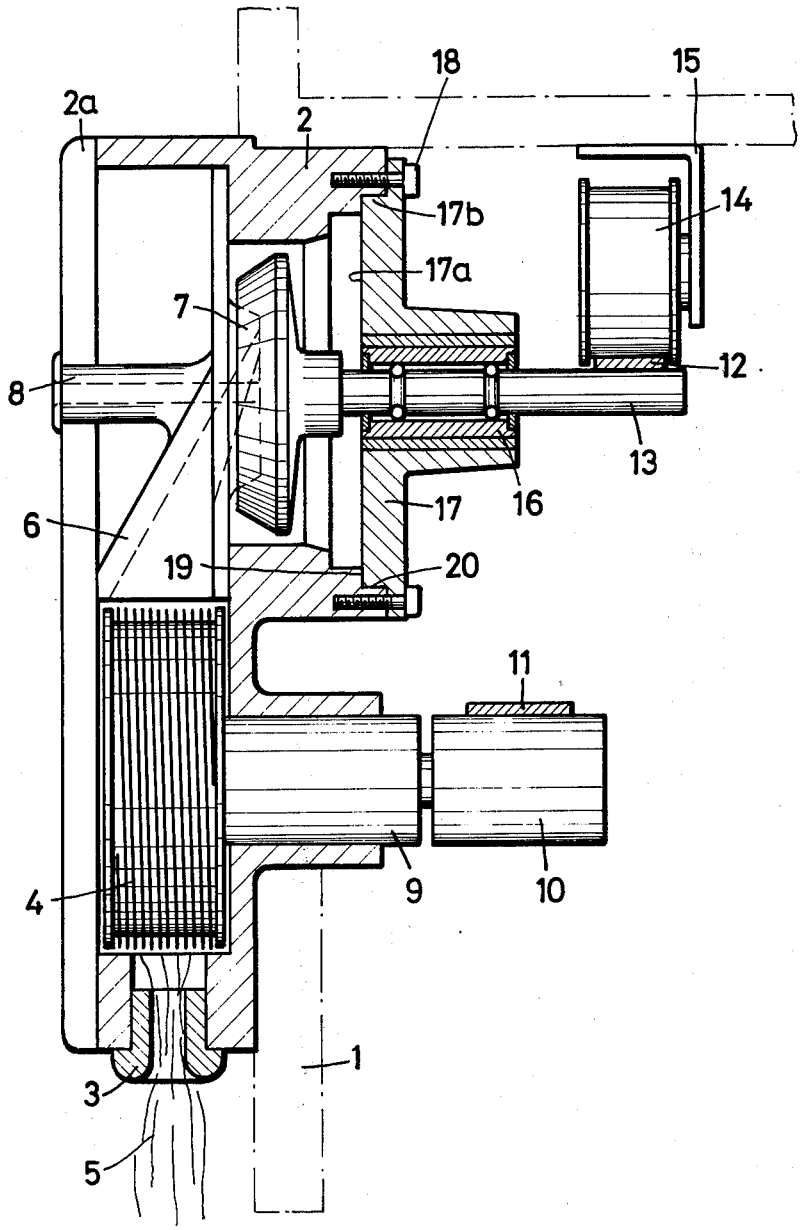
FIG. 1 is a sectional view of a spinning unit of an open end spinning machine with a spin rotor journalled in a roller bearing.

In the figures, there is illustrated generally a spinning machine frame indicated in dash-dotted lines by the numeral 1, on which a plurality of housings 2 are managed in side-by-side juxtaposition with predetermined mutual spacing. Each of the housings have a hinged or pivotal cover *2a*. The housing 2 and cover *2a* define individual spinning units or assemblies which are each movable relative to the machine frame 1.

The sliver band 5 is supplied through an intake funnel 3 mounted in the housing 2, by a suitable feed means not shown in the drawing. The sliver passes a separating roller 4 where it is dissolved into individual fibers which, in turn, are fed through a channel or canal 6 unitarily joined to the cover 2*a*, to the inner working chamber of a spin rotor 7 where they are twisted into a thread. The thread or yarn so formed is withdrawn through a tubular nipple 8 attached to the canal 6 and arranged along the axis of rotation of the rotor and is wound on a bobbin by means not shown in the drawing.

The separating roller 4 is mounted at the end of a shaft rotatably journalled within a bearing 9 joined to the housing 2 and is driven via a whorl 10 by an endless drive belt 11. The belt 11 runs over drive and guide pulleys, not shown, in the head and base parts of the machine and is guided inside the machine by guide rollers likewise not shown to drive the separator roller of each spinning unit.

The spin rotor 7 is mounted at the end of a shaft 13, and is also driven by an endless drive belt 12 which acts upon the free rear end of a shaft 13. The drive belt 12 is guided by guide rollers 14 which lie generally above the shafts 13 and which are rotatably mounted in a bracket 15 which are attached to the machine frame 1 with mutual spacing, over the length of the machine. The guide rollers 14 are held in brackets 15 which are adjustable within a given range in the direction of the longitudinal axis of the shaft 13, in order to provide a proper engagement with the shaft and to ensure adaptation to the various types of bearings journalling the shaft 13. That is, the brackets may be movable along the length of the shaft 13 from a position adjacent the housing 2 (left in the drawing) to a position at the extreme free end of the shaft 13 (right in the drawing). The bracket may be mounted by suitable screws, bolts or similar fasteners. The drive belt 12 also runs over drive and guide pulleys, not shown, in the head part and base part of the frame. These may also be adjustably mounted or they can be of a width commensurate with the axial adjustment range of the frackets 15, if they are mounted so as not to be adjustable.

As seen in FIG. 1, the housing 2 is formed of a first portion accommodating the spin rotor 7 amongst other elements, while the shaft 13 supporting the spin rotor 7 is rotatably mounted within radial roller bearing 16 which is mounted in a bearing mount 17 forming a second housing portion which is joined to the housing 2 by indicated fasteners 18.

In order to secure the fixed position of the bearing mount 17 and thus of the spin rotor 7 within the housing 2, the housing 2 is provided with an interior enlargement or boss, which is cut with shoulders to provide axial contact surfaces 19 running generally perpendicular to the axis of the rotor 7. Adjacent to the contact surfaces 19, an annular cylindrical surface 20 is formed, acting as a radial contact surface. Both the perpendicular and radial contact surfaces 19 and 20 interact with the corresponding counter surfaces 17*a* and 17*b* formed on the bearing mount 17 in such a manner that a firm position of the spin rotor 7 axially and radially is ensured.

Figure 2:
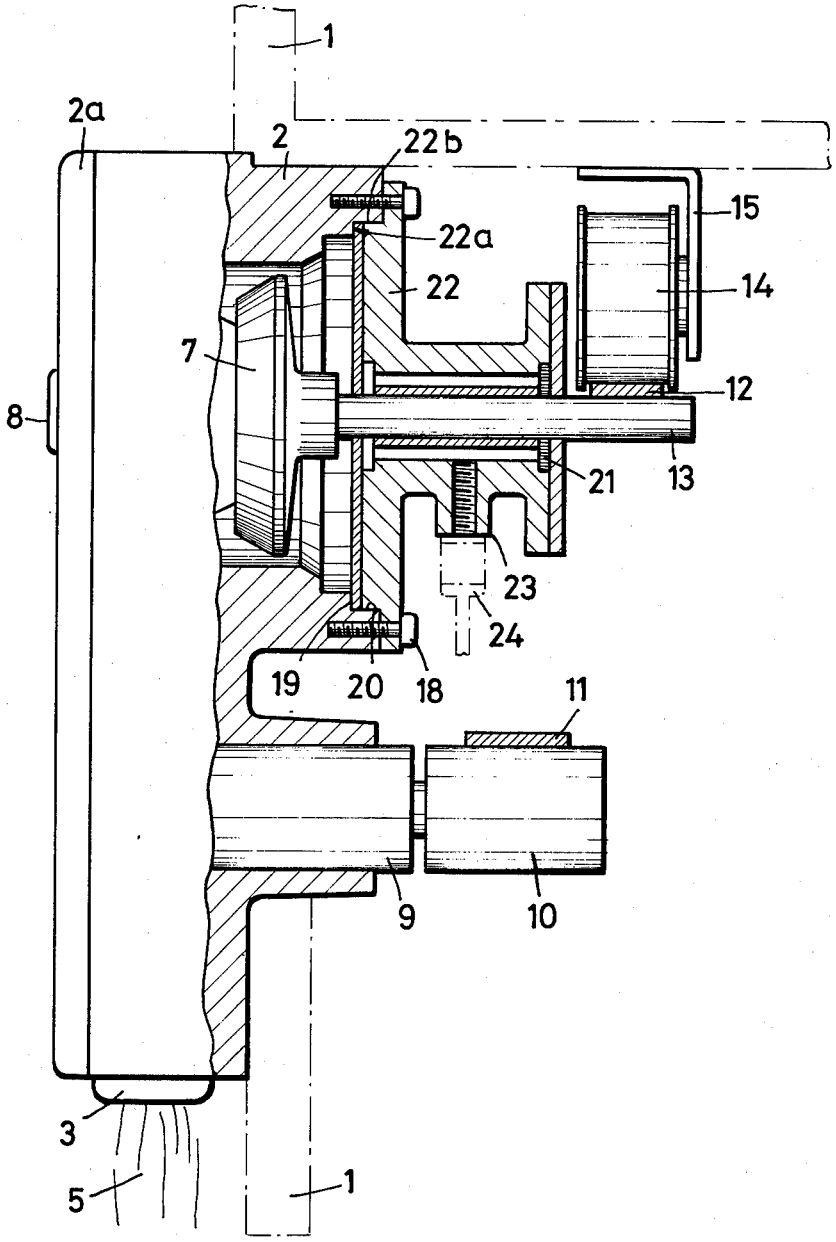
FIG. 2 is a view of a spinning unit similar to FIG. 1 in which the spin rotor is journalled in a gas bearing.

In the embodiment according to FIG. 2, the housing cover 2*a* is shown unsectioned, the parts enclosed by the housing cover 2*a*, however, remaining unchanged as shown in FIG. 1. However, the shat 13 of the spin rotor 7 is rotatably journalled in a fluid bearing, such as in a hydraulic, pneumatic or gas bearing 21, and secured in axial direction in a mount 22. On its side facing the housing 2, the bearing mount 22 has, similar to the design shown in FIG. 1, surfaces 22*a* extending in an axial direction, and surfaces 22*b* extending in a radial direction, which interact with corresponding housing surfaces 19 and 20 so that the position of the spin rotor 7 is secured the same as though a roller bearing 16 were used as shown in FIG. 1, for instance. Furthermore, the bearing mount 22 is provided with a nipple 23 for the attachment of a supply line 24, indicated in dash-dotted lines, for the bearing medium such as gas or fluid.

The position of the guide roller 14 for the drive belt 12 remains unchanged from the arrangement shown in FIG. 1. Naturally, since the brackets 15 are adjustable and/or removable within the machine frame 1, adaptation to another type of bearing can also be made, as is evident from FIG. 3 of the drawing.

Figure 3:
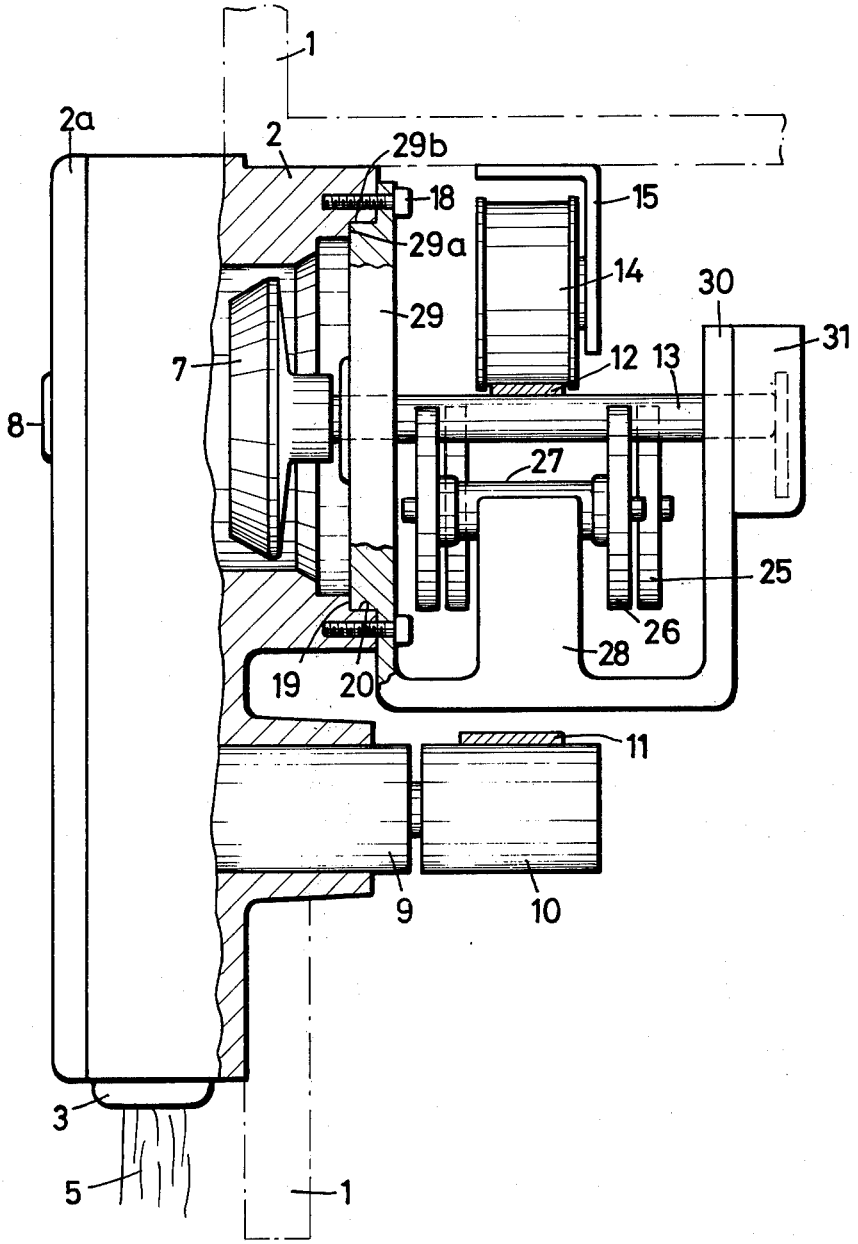
FIG. 3 is a view of an identical spinning unit with a spin rotor journalled in a pair roller supporting bearing.

In FIG. 3, the spin rotor 7 is also attached to a shaft 13 which, however, has its free end projecting into the interior of the housing 2. The shaft 13 rests on and has its surface in contact with two pairs of supporting or backing rollers 25 and 26 spaced a predetermined distance apart from each other. The shaft 13 is driven by the drive belt 12 located midway of its length of act upon the top side of the shaft 13, between each pair of supporting backing rollers 25, 26. The backing rollers 25 and 26 are secured respectively at the ends of shafts each journalled in a bearing 27 held in a block 28 integrally formed in a U-shaped bearing housing 29. The side of the bearing housing 29 facing the housing 2 comprises a mount assembly which is provided with counter surfaces 29*a* to fix the bearing housing in an axial direction and with counter surfaces 29*b* to fix the bearing housing in a radial direction, with the corresponding contact surfaces 19 and 20 so that the result is a position of the spin rotor 7 within the housing 2 which is in agreement with the desired operating position, in the manner discussed earlier.

In addition to the block 28, the bearing housing 29 has a support 30 for the accommodation of a thrust bearing 31 which secures the free end of the shaft 13 of the spin rotor in the axial direction.

Due to the fact that the position of the bracket 15 is adjustable within the machine frame 1, it is possible to axially adjust the guide roller 14 with the drive belt 12, whose running level is essentially constant, to that part of the shaft 13 of the spin rotor 7 which is located between the pairs of supporting rollers 25, 26.

Figure 4:
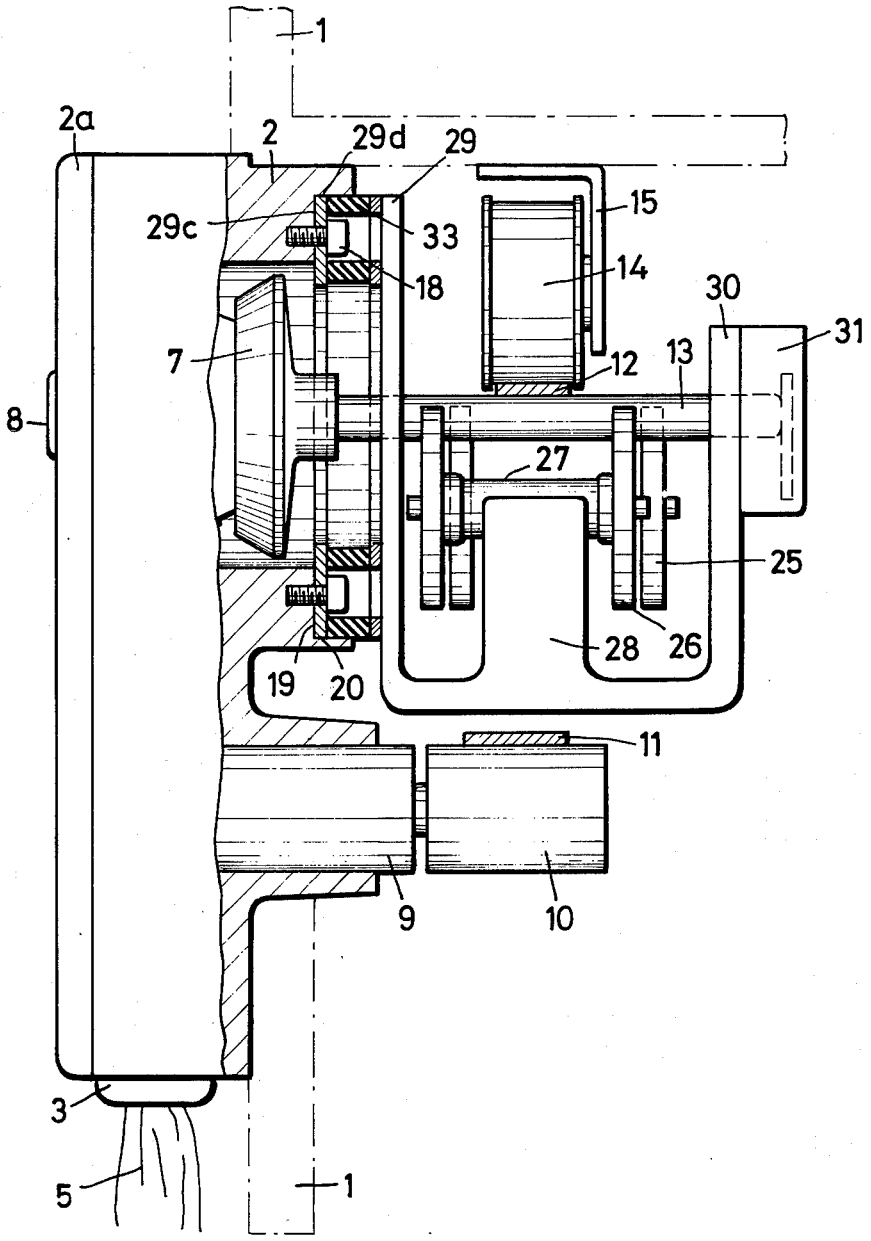
FIG. 4 is a modified design of the arrangement of the unit of FIG. 3.

In FIG. 4, a mounting which essentially corresponds to the arrangement of FIG. 3, is shown. The bearing housing 29 is provided with contact surfaces 29*c* and 29*d* which rest against the associated contact surfaces 19 and 20 of the housing 2. These contact surfaces 29*c* and 29*d* are formed by parts of a plate which has on its side facing the bearing housing 29 an elastic member such as rubber, synthetic rubber or plastic, in the form of a ring 33 connected either directly or through another plate to the bearing housing 29 to form a unitary subassembly.

The elastic ring 33 has holes for the heads of the fasteners 18, and the plate resting against the housing 2 has through holes for the screw shanks which are anchored in the housing 2. The position and arrangement of the other components are essentially those shown in FIG. 3.

Figure 5:
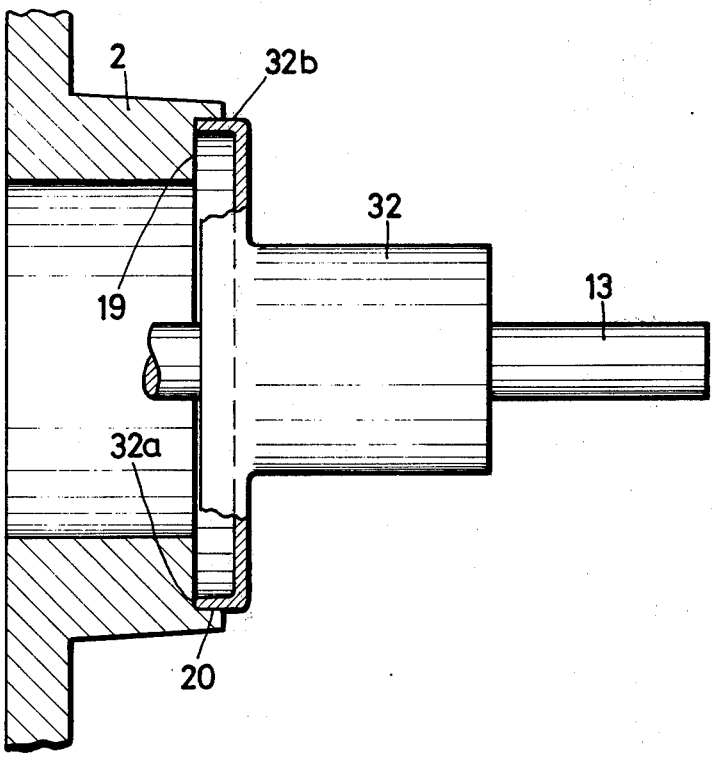
FIG. 5 is an enlarged view of a modified connection between the housing portions.

In every instance, the proper operating position of the spin rotor 7 within the housing 2 is determined by the contact surfaces of housing 2, it being also possible to modify these bearing surfaces, such as shown in FIG. 5. of the drawing, for instance.

In FIG. 5, the bearing 32 for the shaft of the spin rotor 7 is provided with a radially enlarged cup shaped flange head having an axial skirt 32*b* and a radial lip 32*a*. A radial contact surface 19 in the form of a shoulder, and an annular radial surface 20, are again formed on the housing boss to provide corresponding contact surfaces. The angular ring parts or segments of the bearing 32 engage and fit within the recesses formed by surfaces 19 and 20 in the housing 2; the face 32*a* making contact with the shoulder 19 and the outer surface 32*b* of the housing bearing 32 with the cylindrical surface 20. The part of the bearing housing 32 which faces the housing 2 may be formed either as a continuous ring or annulus and secured to the housing 2 by suitable screws or bolts. On the other hand, the portions 32*a* and 32*b* can be divided into individual spaced segments meshing with correspondingly constructed portions or segments defining surfaces 19, 20 in the housing 2. The segments will form teeth or ratchet-like sections which will secure the bearing 32 against rotation and secure its position in circumferential direction. As in the embodiments of FIGS. 1 to 3, the bearing housing 32 can be also fastened by means of screws.

Naturally, other fastening modes are also possible within the scope of the invention, such as quick connectors, bayonet connectors or clamp means which may act like clamp connectors, connecting the bearing housing to the housing 2 with the required rigidity.

It will also be seen from FIG. 3 or 4 that each of the rotors may be provided with an individual electric drive motor. The motor may be mounted on the vertical axis 30 in conventional manner either in contact with drive shaft, or with the drive shaft as part of the motor shaft itself.

Various changes, modifications, as well as embodiments, have been suggested herein, others will be obvious to those skilled in this art. Accordingly, it is intended that the present disclosure be taken as illustrative only and not as limiting of its scope.

What is claimed is:

1. An open end spinning machine comprising a frame, a plurality of spinning units disposed in side-by-side juxtaposition on said frame, each spinning unit comprising a housing and having at least a spinning rotor mounted at the end of a shaft jouralled in a shaft bearing, means for feeding fibers to said rotor, and means for withdrawing the yarn formed in said rotor, said machine having drive means for driving the shaft of each of the rotors in each of said spinning units and the guide means for mounting said drive means on said frame, said housing comprising a first portion accomodating said spinning rotor, and a second portion in which said bearing for said rotor shaft is fixedly mounted, said first and second housing portions being separably secured together and having cooperatively engaging contact surfaces and counter-contact surfaces respectively permitting exchange of said rotor and rotor shaft and being effective to secure said second portion against axial and radial movement with respect to said first portion, said guide means being adjustable along the axis of said rotor shaft to permit engagement of said drive means and said rotor shaft irrespective of the shaft bearing employed.

2. The open-end spinning machine according to claim 1, wherein said contact surfaces on said first housing portion comprises an annular part forming a radial limit stop and a transverse shoulder forming an axial limit stop, and said second housing portion is provided with a radially extending flange corresponding to the diameter of said annular contact part.

3. The open-end spinning machine according to claim 2, including holes formed in the annular flange and transverse contact parts, and fastening means adapted to enter said holes and secure the housing portions together.

4. The open-end spinning machine according to claim 1, wherein said contact and counter-contact surfaces are formed of spaced teeth-like segments adapted to mate and mesh with each other and secure said housing parts against rotation.

5. The open-end spinning machine according to claim 1, wherein said drive means comprises an endless belt extending the length of said machine, and said guide means is adjustable to position said belt in contact with the surface of said rotor shaft.

6. The open-end spinning machine according to claim 1, wherein said shaft bearing is a roller bearing, fluid bearing, or cradle bearing.

7. The open-end spinning machine according to claim 1 wherein said drive means comprises an electric motor mounted on the second housing portion in contact with said rotor shaft.

8. The open-end spinning machine according to claim 1, including elastic resilient means interposed between the contact and counter-contact surfaces.

9. The open-end spinning machine according to claim 8, wherein said elastic means comprises a subassembly of an annulus having engaging surfaces for abutment with the contact and counter-contact surfaces.

* * * * *